US006024235A

United States Patent [19]

Schwab

[11] Patent Number: 6,024,235

[45] Date of Patent: Feb. 15, 2000

[54] CONTAINER SEAL WITH A SEALING BODY WHICH CAN BE PUNCTURED

[75] Inventor: Jürgen Schwab, Wetter, Germany

[73] Assignee: Dade Behring Marburg GmbH, Marburg, Germany

[21] Appl. No.: 08/347,201

[22] Filed: Nov. 21, 1994

Related U.S. Application Data

[63] Continuation of application No. 07/865,501, Apr. 9, 1992, abandoned.

[30] Foreign Application Priority Data

Apr. 13, 1991 [DE] Germany ..... 41 12 209

[51] Int. Cl.[7] ..... B65D 39/00

[52] U.S. Cl. ..... 215/247; 215/274; 215/355

[58] Field of Search ..... 215/247, 249, 215/274, 355, 363, 364, DIG. 3; 141/329

[56] References Cited

U.S. PATENT DOCUMENTS

| | | | |
|---|---|---|---|
| 2,099,370 | 11/1937 | Monnier | 215/247 |
| 2,153,981 | 4/1939 | Heineman | 215/248 |
| 2,579,724 | 12/1951 | Breakstone | 215/247 |
| 3,067,425 | 12/1962 | Colley | 141/329 X |
| 3,343,699 | 9/1967 | Nicko | 215/247 |
| 3,496,969 | 2/1970 | Bruce et al. | 141/329 X |
| 3,823,840 | 7/1974 | Zackheim | 215/247 |
| 4,163,500 | 8/1979 | Gunne et al. | 215/260 |
| 4,187,952 | 2/1980 | Percarpio | 215/247 |
| 4,366,912 | 1/1983 | Matukura et al. | 215/247 |
| 4,554,125 | 11/1985 | Knapp | 215/364 X |
| 4,664,274 | 5/1987 | Konrad | 215/232 |
| 4,834,152 | 5/1989 | Howson et al. | 141/286 |
| 4,915,243 | 4/1990 | Tatsumi et al. | 215/247 |
| 5,060,812 | 10/1991 | Ogle, II | 215/247 |
| 5,111,946 | 5/1992 | Glanz | 215/247 |

FOREIGN PATENT DOCUMENTS

| | | | |
|---|---|---|---|
| 1 901 239 | 11/1975 | Germany . | |
| 558998 | 1/1944 | United Kingdom | 215/247 |

*Primary Examiner*—Stephen P. Garbe
*Attorney, Agent, or Firm*—Finnegan, Henderson, Farabow, Garrett & Dunner, L.L.P.

[57] ABSTRACT

The invention relates to a container seal with a sealing body which can be punctured for supplying or removing liquids to or from a container (3) by means of a blunt hollow needle (10), this sealing body consisting at least partially of a highly elastic material in which a cut is made at the puncture point (23) through at least 75% of its thickness. The seal can in this case be designed independently in the form of a stopper or as a small insert plate for a seal.

8 Claims, 5 Drawing Sheets

Figure 1:
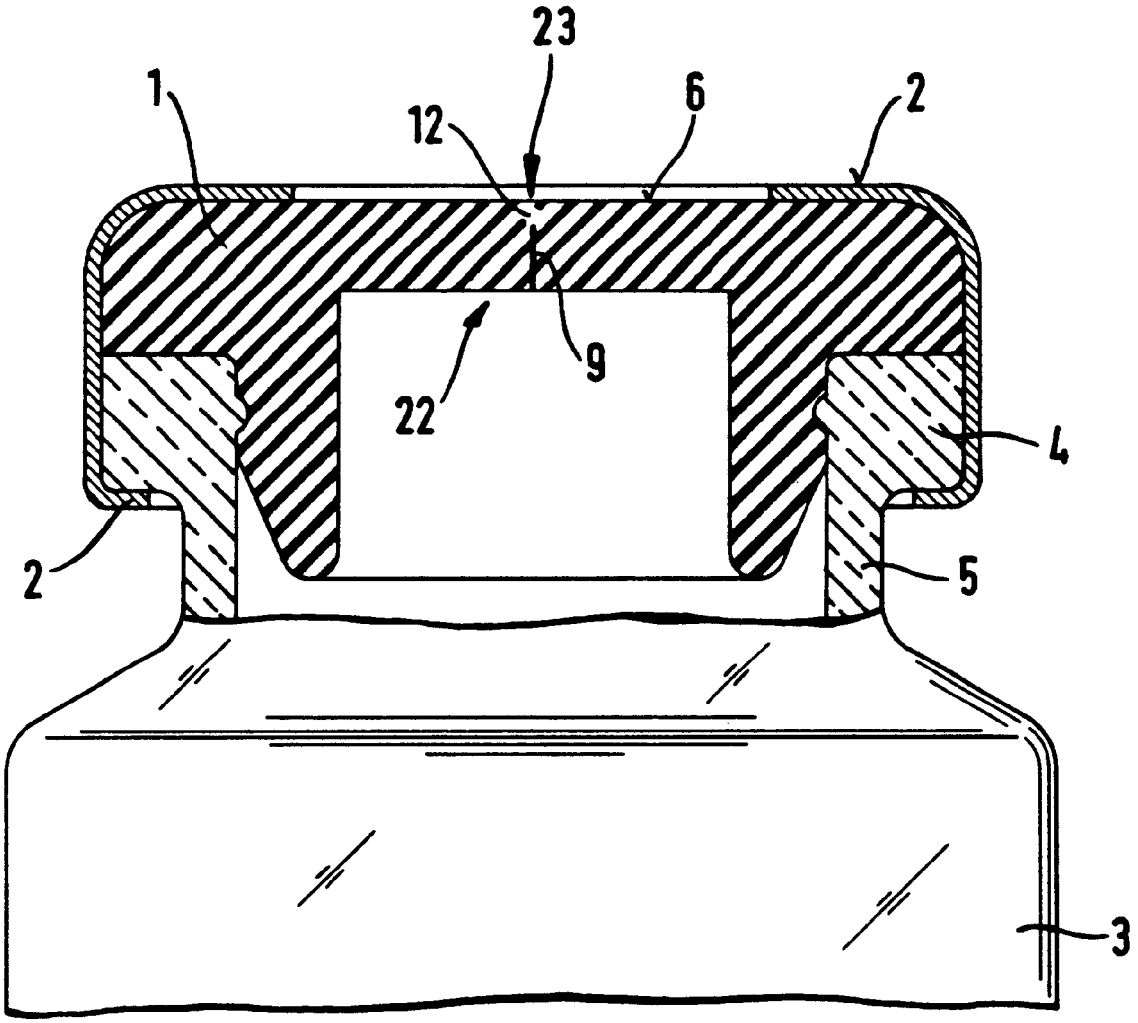

Fig. 2a
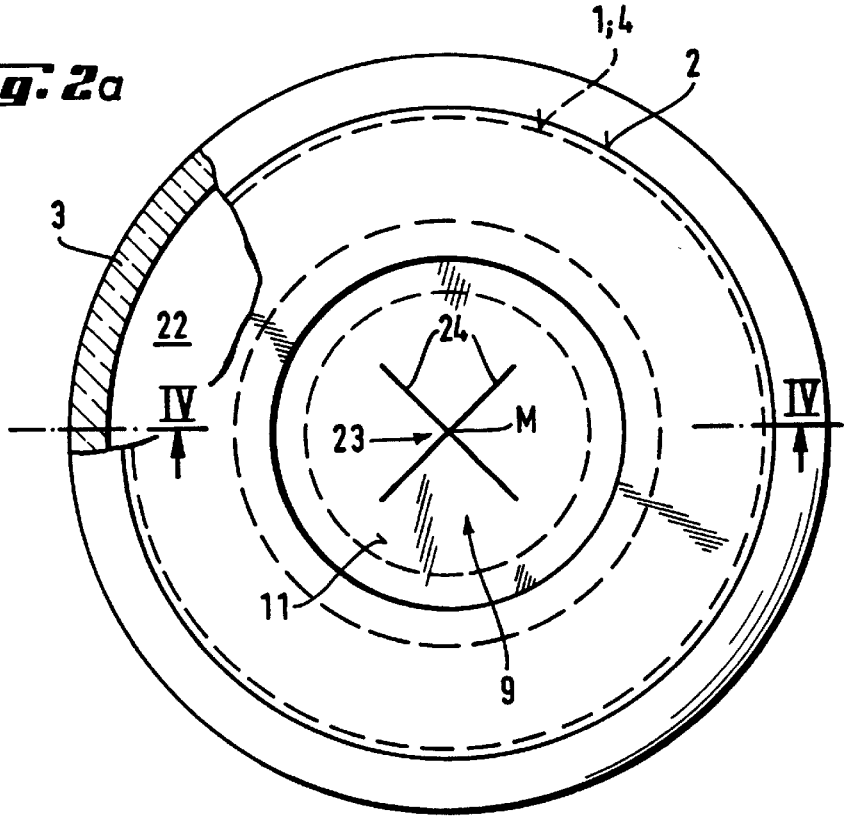
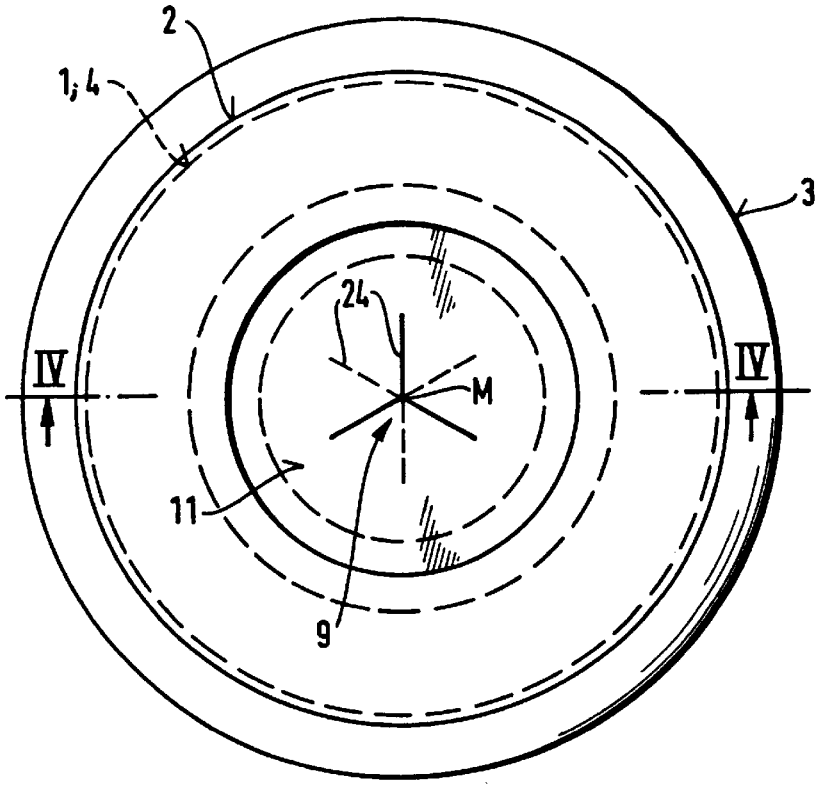
Fig. 2b

CONTAINER SEAL WITH A SEALING BODY WHICH CAN BE PUNCTURED

This application is a continuation, of application Ser. No. 07/865,501, filed Apr. 9, 1992, now abandoned.

The invention relates to a container seal with a sealing body which can be punctured for supplying or removing liquids to or from a container by means of a blunt hollow needle, this sealing body consisting at least partially of a highly elastic material in which a cut is made at the puncture point through at least 75% of its thickness. The seal can in this case be designed independently in the form of a stopper or as a small insert plate for a seal.

In the area of diagnostic apparatuses, samples, mostly of human body fluids, control samples, some of which are analyte-containing fluids with an artificial matrix and reagents are pipetted with the aid of automatic pipetting stations. These apparatuses essentially consist of a cannula which is movable in the X-Y-Z direction and which is connected to a pump facility via a flexible tube. Due to the design of these apparatuses, only slight forces can be exerted on the cannula. For reasons of work safety, the use of sharp-edged cannulas is prohibited. For various reasons, such as, for example, the risk of infection or the danger of evaporation, the vessels containing the samples/reagents must be hermetically sealed before, during and after pipetting, and this seal must be guaranteed even after it has been used several times/repeatedly.

Apparatuses within the meaning of this invention are all instruments which carry out a transfer of liquid to or from a container or with which a transfer of liquid to or from a container can be carried out. Apparatuses which are preferred in this case are those which carry out this transfer automatically. Particularly preferred are those apparatuses which are used in the area of diagnosis of disorders of the human or animal organism.

Similar container seals are already known for containers with pharmaceutical contents. In these cases, the cannula of a syringe is used to puncture the sealing body at an optionally weakened point, and the contents of the bottle are filled into the hypodermic syringe, without the bottle seal having to be removed. In order to facilitate this procedure, it is also known to design the sealing bodies as stoppers fitting in the neck of the bottle, the shank of these stoppers being hollow, apart from a bottom surface, and this bottom surface having a convex arch directed away from the inside of the bottle.

The sealing bodies of known bottle seals of this type generally consist of butyl rubber, natural rubber or silicone rubber or similar materials, which have sufficient chemical resistance to their environment and in particular to the contents of the bottle. A known design of this type is shown, for example, in Patent Specification DE 1,901,239.

The disadvantage of the known embodiments is that they cannot be used with blunt cannulas, and even when sharpened injection needles are used a relatively large force must be applied in order to puncture the sealing bodies.

The aim of the present invention was therefore to provide a sealing body which can be punctured, for the purpose of liquid transfer, with slight force application by means of a blunt cannula, and which guarantees a reliable and hygienic seal before, during and after the removal, and does so in particular after repeated use. The outer contours of this sealing body should be as similar as possible to those of the previously known and used sealing bodies, so that, for example, the machines already in use for sealing do not need to be converted.

The solution according to the invention consists in the fact that, in the case of such a bottle seal, the combination of the following features is provided:

Container seal with a sealing body which can be punctured for the transfer of liquid to or from a container by means of a hollow needle, this sealing body being characterized by the combination of the following features:

a) the sealing body (1) consists, at least in the puncture area (23), of elastic material, such as natural rubber or synthetic rubber, such as, for example, silicone rubber, bromobutyl rubber or chlorobutyl rubber, which may also optionally be coated with PTFE, in particular of butyl rubber b) the sealing body is cut (9) in the puncture area (23) through at least 75% of its thickness, preferably starting from the inside of the container.

A container seal as described above is preferred in which the incision (9) consists of 4 cuts (24), preferably of equal length, which start from the center of the sealing body and are arranged at right angles to one another.

The invention moreover relates to a container seal, as described hereinabove, which consists of a sealing body bottom part (15) and a covering membrane (14).

The invention also relates to a container seal, as described hereinabove, in which the seal consists of a small plate (20).

Tests have now shown surprisingly that, with the design of the sealing body according to the invention, it is possible to satisfy both the requirement that the seal should be capable of being punctured, as well as the requirement that the sealing body should be resealable and reliable. The material thickness of the sealing body can vary widely.

Containers within the meaning of the present invention are, for example, vessels which are used to receive samples of body fluids, such as, for example, test tubes or blood-collection vessels, and in addition containers which are used to receive reagents or liquid residue in vessels. The various embodiments are known to the specialist.

The container seal according to the invention can be a basic component of any seal arrangement which is known per se to the specialist and which can be made partially or completely from a highly elastic material.

In a preferred embodiment, the material thickness of the sealing body in the area of the perforation point is 0.1–5, preferably 1–3, particularly preferably 2 mm.

Figure 3:
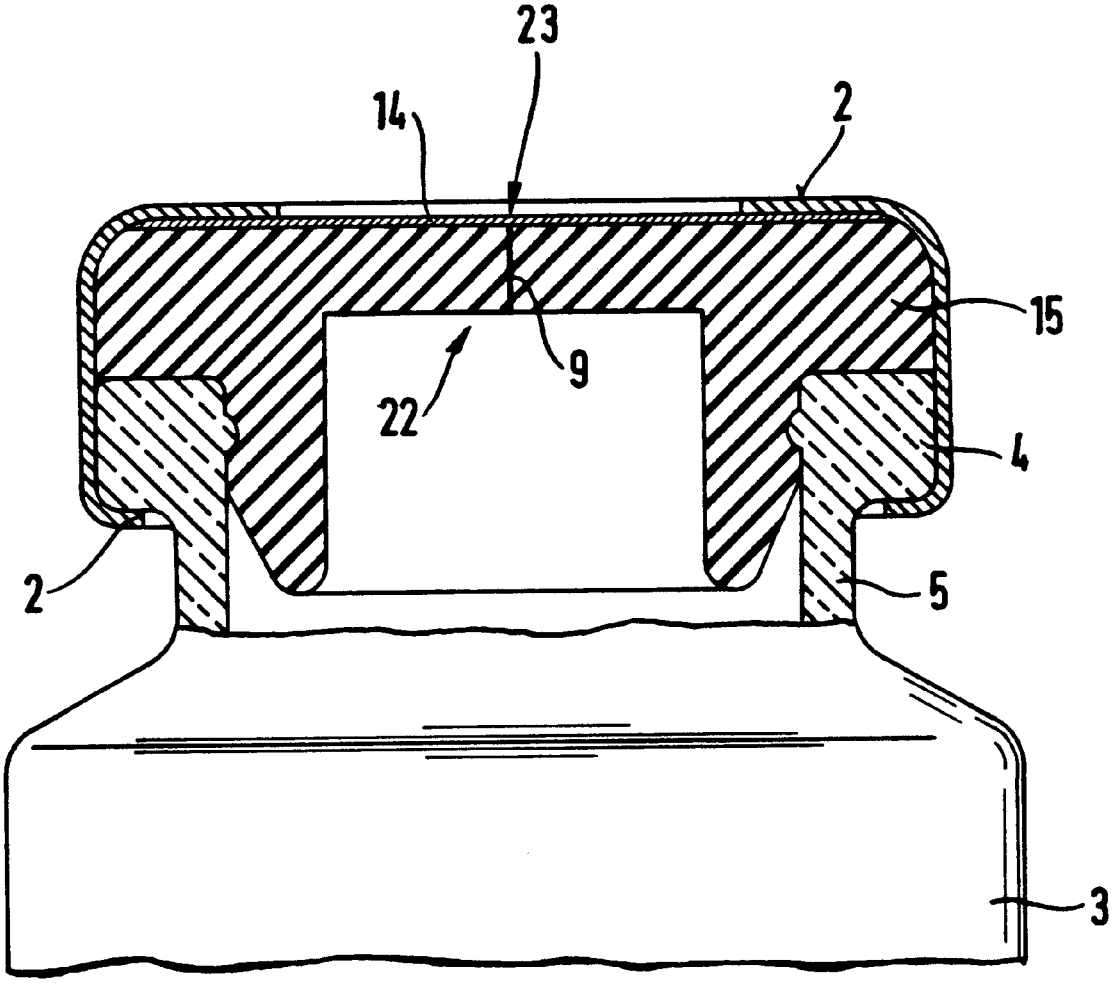
Figure 4A:
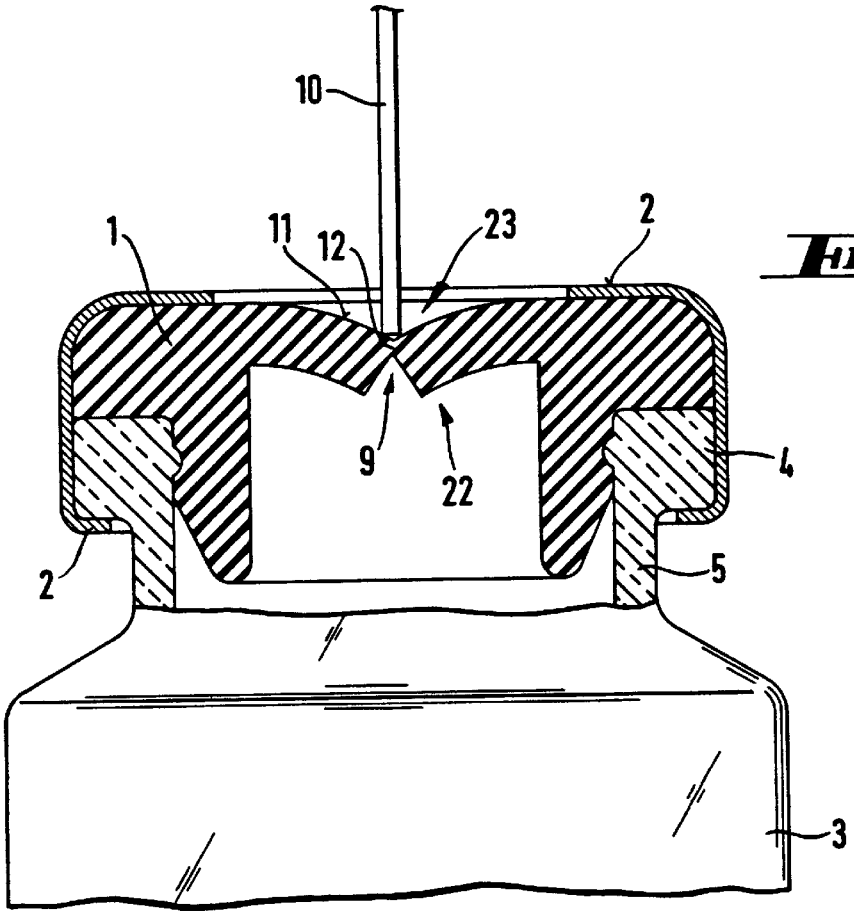
Figure 4B:
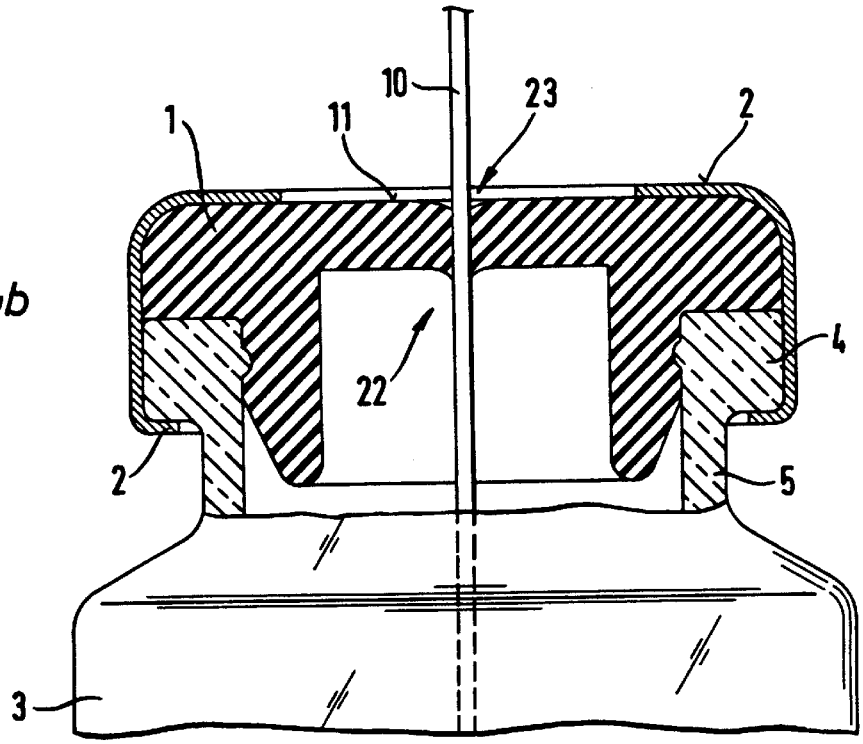
Figure 5A:
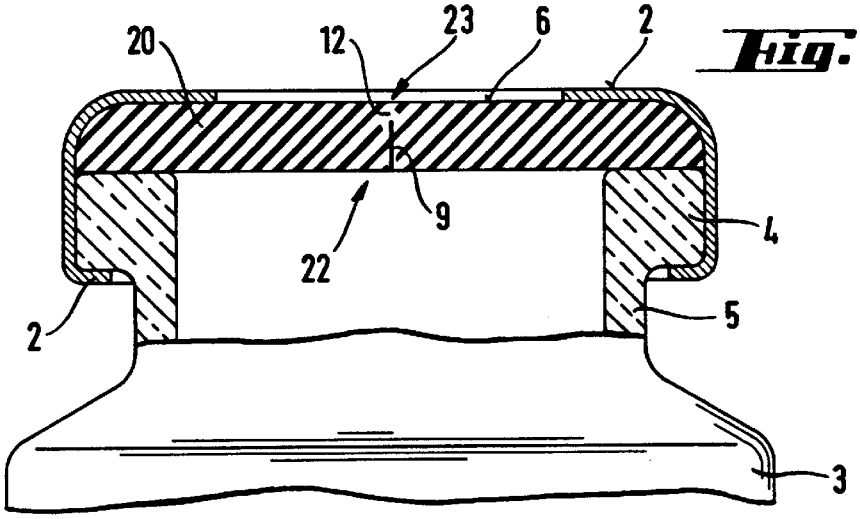
Figure 5B:
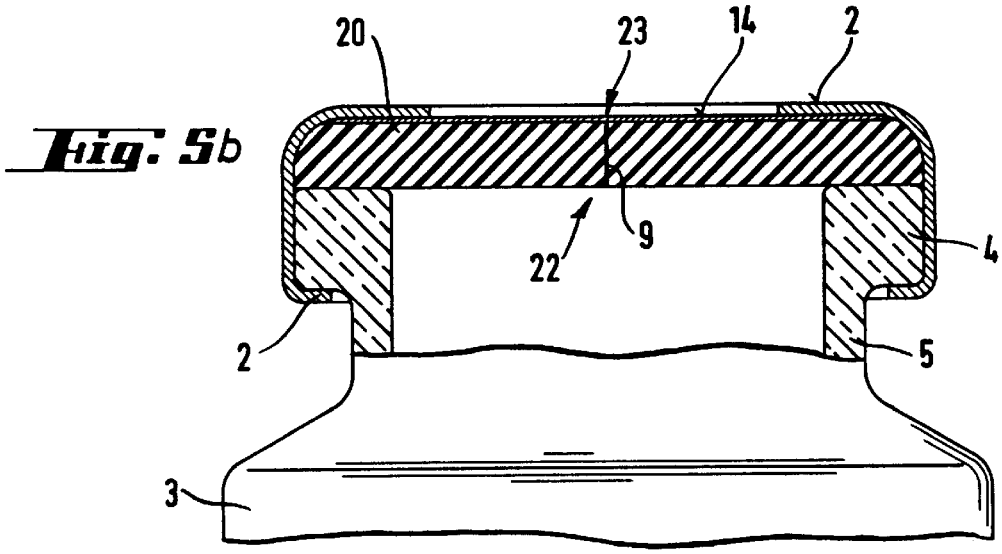
Figure 5C:
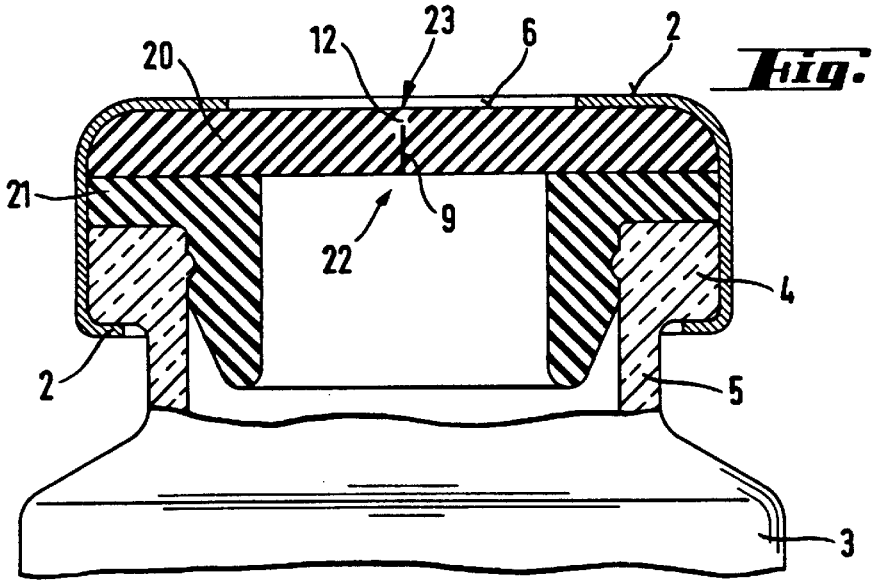

The invention is described in greater detail hereinbelow with reference to the drawings, which are in different scales and in which:

FIG. 1: shows a longitudinal section through a bottle seal and the upper part of a bottle, FIGS. 2*a* and *b*: show views of two embodiments of a bottle seal with differently shaped incisions, FIG. 3: shows a longitudinal section through a further embodiment of the sealing body with a separate membrane, FIGS. 4*a* and *b*: show longitudinal sections through a container seal according to FIG. 1 with different depths of insertion of the cannula, and FIGS. 5*a* to *c*: show longitudinal sections through further preferred embodiments of the container seal.

A container seal consists of a sealing body (1) and if appropriate a beaded cap (2) (FIG. 1) or screwcap. The beaded cap (2) is of annular design and engages under the flange-like collar (4) of the neck (5) of a container, while the screwcap engages correspondingly in a thread on the neck of a container (3). The beaded cap (2) or the screwcap leaves the end face (6) of the sealing body free in the central area. The sealing body (1) is in this way pressed in a conventional manner against the neck (5) of the container under a sealing pressure and is secured thereon.

In the center of the end face (6), the sealing body (1) has a preferably cross-shaped incision (24), preferably of about 5 mm, starting from the center M of the sealing body (1), the incision preferably passing through between 75 and 90% of the material thickness at the incision point (9). The remaining membrane (12) ensures, inter alia, the hermetic seal and the necessary mechanical stability on storage and transportation. The material thickness in the cut-in part (9) is preferably 0.1–5 mm. In this way it is ensured that a sufficient amount of material is present around the puncture in order to obtain an adequate area of sealing for the reliable closure of the container (3) after the removal of the cannula from the incision point (9).

The particular manner of operating with the container seal according to the invention is illustrated herein-below (FIGS. 4*a, b*).

When the cannula (10) comes into contact with the surface (11) of the sealing body (1), the whole incision point (9) is first of all stretched by the pressure of the cannula (10). As the cannula is advanced further, tensile forces occur corresponding to the further stretching in the area of the membrane (12), these tensile forces causing the membrane (12) to tear at the incision point. It is then possible for the cannula (10), sealed off by the material of the sealing body at the incision point, to remove liquid from the container or introduce liquid into the container.

The sealing body (1) illustrated in FIG. 3 has a separate covering membrane (14), which can be connected to the sealing body bottom part (15) either by pressure, adhesion or cohesion. At the incision point (9), the sealing body bottom part (15) is cut through the entire material thickness. The membrane (14) can preferably be made of a slightly elastic material of low tear strength, such as, for example, aluminum foil. In this case the material thickness can be even less than 0.1 mm.

The sealing body (1) illustrated in FIGS. 5 (*a–c*) consists of a small plate (20) of a highly elastic material (septum) and a beaded cap (2) or a screwcap, which press the small plate (20) either directly onto the flange surface of the collar (4) (FIG. 5*a*) of the container (3) or onto a support (21) (FIG. 5*c*), which in turn can be made of an elastic material. The puncture area (23) (cf. claims 1 and 2) of the small plate can be designed as illustrated in FIG. 1 (FIG. 5*a* and 5*c*) or as in FIG. 3 (FIG. 5*b*).

As illustrated in FIG. 2, the sealing body in each of the embodiments according to the invention can have a line-shaped, cross-shaped (FIG. 2*a*) or star-shaped (FIG. 2*b*) incision. Embodiments with a cross-shaped and trifurcate incision are preferred.

The incisions are preferably made in such a way that they are open towards the inside (22) of the container.

I claim:

1. A container seal which can be punctured for repeated liquid transfer to and from a container by means of a hollow needle, comprising:

an elastic sealing member having a top surface and a bottom surface and a puncture area on the top surface, the sealing member including only one incision therein, the incision positioned below the puncture area and extending from the bottom surface through at least 75% but less than 100% of the thickness of the sealing member to define a layer between the incision and the puncture area which is capable of being punctured by a hollow needle to facilitate liquid transfer from a container, the layer consisting of rubber.

2. The container seal of claim 1, wherein the elastic sealing member is formed entirely of a material chosen from the group consisting of natural rubber and synthetic rubber.

3. The container seal of claim 1, wherein the elastic sealing member is formed of a material chosen from the group consisting of silicone rubber, bromobutyl rubber and chlorobutyl rubber.

4. The container seal of claim 1, wherein the elastic sealing member is formed of butyl rubber.

5. The container seal of claim 1, wherein the elastic sealing member is coated with polytetrafluorethylene.

6. The container seal of claim 1, wherein the incision includes four cuts located beneath the center of the puncture area and arranged at right angles to one another.

7. A sealable container, comprising:

a container including an opening; and a sealing member for sealing the opening of the container, the sealing member including a top surface and a bottom surface, a puncture area on the top surface, and only one incision in the sealing member, the incision extending below the puncture area from the bottom surface through at least 75% but less than 100% of the thickness of the sealing member to define a layer consisting of rubber between the incision and the puncture area that is capable of being punctured by a hollow needle to facilitate liquid transfer from the container.

8. A container seal which can be punctured for repeated liquid transfer to and from a container by means of a hollow needle, comprising:

an elastic sealing member having a top surface and a bottom surface and a puncture area on the top surface, the sealing member including only one incision therein, the incision positioned below the puncture area and extending from the bottom surface through at least 75% but less than 100% of the thickness of the sealing member to define a layer between the incision and the puncture area which is capable of being punctured by a hollow needle to facilitate liquid transfer from a container and is substantially resealable after the needle is withdrawn from the container.

* * * * *